United States Patent [19]

Gloor

[11] Patent Number: 4,699,569

[45] Date of Patent: Oct. 13, 1987

[54] ROTOR BLADE RING OF AN AXIAL FLOW TURBOMACHINE

[75] Inventor: Kurt Gloor, Meyriez/Murten, Switzerland

[73] Assignee: BBC Brown, Boveri & Company, Limited, Baden, Switzerland

[21] Appl. No.: 877,123

[22] Filed: Jun. 23, 1986

[30] Foreign Application Priority Data

Jul. 5, 1985 [CH] Switzerland ..... 2892/85

[51] Int. Cl.[4] ..... F01D 5/22

[52] U.S. Cl. ..... 416/191; 416/190; 416/196 R

[58] Field of Search ..... 416/190, 191, 195, 218, 416/221, 196 R, 500

[56] References Cited

U.S. PATENT DOCUMENTS

| | | | |
|---|---|---|---|
| 764,450 | 7/1904 | Geisenhöner | 416/191 |
| 1,061,648 | 5/1913 | Westinghouse | 416/191 |
| 1,165,005 | 12/1915 | Herr | 416/191 |
| 1,542,402 | 6/1925 | Meissner | 416/196 |
| 2,771,267 | 11/1956 | Weymouth, Jr. | 416/196 R |
| 2,846,184 | 8/1958 | Tournere | 416/218 X |
| 3,377,050 | 4/1968 | Guy | 416/191 |
| 3,501,247 | 3/1970 | Tournere | 416/195 X |
| 4,268,223 | 5/1981 | Anner et al. | 416/196 R |

FOREIGN PATENT DOCUMENTS

| | | | |
|---|---|---|---|
| 873151 | 6/1971 | Canada | 416/191 |
| 805581 | 5/1951 | Fed. Rep. of Germany | 416/196 R |
| 2606891 | 9/1976 | Fed. Rep. of Germany | 416/221 |
| 344451 | 11/1904 | France | 416/191 |
| 685110 | 7/1930 | France | 416/196 R |
| 26769 | 11/1969 | Japan | 416/195 |
| 46005 | 3/1982 | Japan | 416/196 R |
| 137605 | 8/1982 | Japan | 416/191 |
| 337214 | 5/1959 | Switzerland . | |
| 593417 | 11/1977 | Switzerland . | |
| 244518 | 12/1925 | United Kingdom | 416/196 R |
| 267405 | 3/1927 | United Kingdom | 416/189 R |
| 1287223 | 8/1972 | United Kingdom | 416/218 |
| 693041 | 11/1979 | U.S.S.R. | 416/190 |

*Primary Examiner*—Everette A. Powell, Jr.

*Attorney, Agent, or Firm*—Burns, Doane, Swecker & Mathis

[57] ABSTRACT

In the rotor blade ring of an axial flow turbomachine, the rotor blades are each provided at their radially outer ends with a shroud plate and are fastened at their radially inner ends, by means of a root, in a corresponding groove of the machine rotor. The shroud plates are connected together in the peripheral direction by means of wires rolled into turned recesses. Grooves (10), with a clear width ($w_1$) which is dimensioned larger than the width ($w_2$) of the shroud plate turned recess (8) provided for the wire (7) to be rolled in, are machined in the end surface (6) of the shroud plate (2). A spacer means (11), surrounding the wire at least in the region of the rolling positions and removable after rolling, is laid in the grooves during the rolling procedure. This material is preferably a hard paper which is burnt to ashes during machine operation.

3 Claims, 5 Drawing Figures

ROTOR BLADE RING OF AN AXIAL FLOW TURBOMACHINE

FIELD OF THE INVENTION

Figure 1:
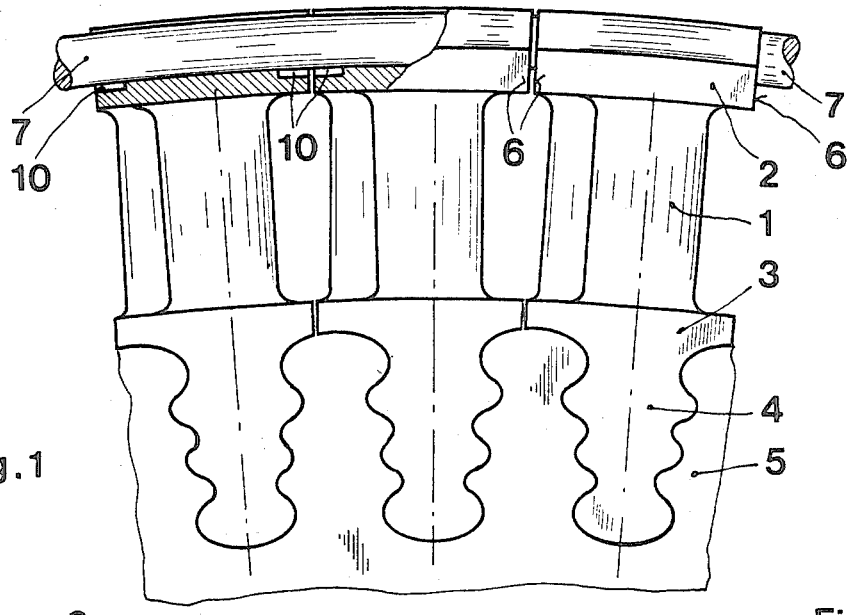

The invention concerns the rotor blade ring of an axial flow turbomachine whose rotor blades are each provided with a shroud plate at their radially outer ends and are fastened at their radially inner ends, by means of a root, in a corresponding groove of the machine rotor, and in which the shroud plates are connected together in the peripheral direction by means of wires rolled into turned recesses.

BACKGROUND OF THE INVENTION

During operation, the individual blades of a turbomachine execute natural frequency vibrations which depend on the type of vibration to which they are subjected-tangential bending, axial bending or torsion. If several blades are connected together to form a group, by means of bandaging, for example, the behaviour of the blades becomes still more complex because each type of vibration has to have allocated to it as many natural frequencies as there are blades in a group. Because of the large number of natural frequencies, it is very difficult to avoid resonance phenomena with periodic excitation forces.

In contrast, continuous connection of all the rotor blades in a wheel leads to completely different behaviour. Since only coupled vibrations of all the blades are possible, the excitation forces must be in phase with the type of vibration over the complete periphery of the wheel if a transfer of energy to the blades is to take place at all. This type of blade connection is particularly useful for the control stage of a turbine whose rotor blades are made to vibrate by periodic forces originating from the vane segments of the first guide vane stage, the nozzle box, and whose frequencies represent a multiple of the frequency of rotation.

A rotor blade ring of the type mentioned at the beginning is known, for example, from the book "Thermische Turbomaschinen" by Walter Traupel, 3rd edition, second volume, Figure 20.21.3 and the associated description. The solution mentioned, i.e. connecting wires caulked into the shroud plates, is referred to as a "design well worth noting".

However, it has been found that frettage corrosion due to vibration occurs at the locations at which the wire penetrates the end surfaces of the shroud plates and this can lead to failure of the wire.

OBJECT AND SUMMARY OF THE INVENTION

In consequence, the object of the present invention is to clamp the wire in a rotor blade ring, of the type mentioned at the beginning, in such a way that it is not subject to any metallic contact with the shroud plate in the region of the end surfaces.

This is achieved, according to the invention, by machining grooves in the end surfaces of the shroud plates, these grooves being dimensioned larger than those of the shroud plate turned recess provided for rolling in the wire, a spacer means surrounding the wire at least in the region of the rolling positions and being removable after rolling, being inserted in the grooves during the rolling procedure.

BRIEF DESCRIPTION OF THE PREFERRED EMBODIMENT

An illustrative embodiment of the invention is represented in the drawing using the impulse wheel of a steam turbine control stage.

Figure 2:
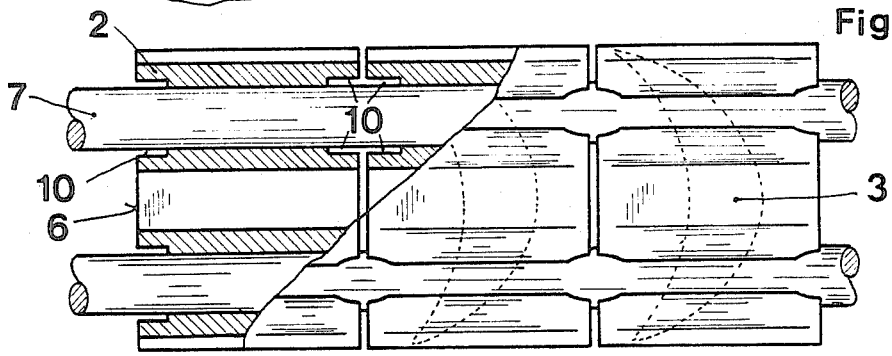

In the drawing:

FIG. 1 shows a view in the axial direction on a wheel section, comprising three rotor blades, with partially sectioned shroud plates, FIG. 2 shows a partially sectioned plan view on the wheel section of FIG. 1, FIGS. *3a–3c* show partial views of a blade in the tangential direction at various stages of processing.

Elements unessential to the invention, such as the flow limiting stator walls surrounding the blading and the nozzle box usually located upstream of the control stage, are omitted.

The control wheel comprises essentially a closed ring of blades whose profiled aerofoil 1, subjected to the working medium, is provided with a shroud plate 2 at its radially outer end. In the example shown, this shroud plate is rectangular; it could, however, equally well be made rhombus-shaped. The cylindrical duct shape, which expresses itself in FIG. *3a* by the inlet part and the outlet part of the blade aerofoil 1 having the same height, is not essential to the invention either; conical duct shapes, in which the conicity is formed by appropriately shaped shroud plates 2 and/or root platforms 3, can also be used. Also unessential to the invention is the type of fastening of the blade root 4 in the rotor 5, the fastening in the present case, taking place by means of fir tree roots which can be inserted axially into corresponding grooves in the rotor.

The extension of the individual shroud plates in the peripheral direction is so dimensioned that, in the cold condition, they butt together by means of their end surfaces 6 and thus form a closed ring.

During normal operation of the assumed full-speed turbomachine, the blades now extend due to centrifugal force, which leads to a clearance of approximately 1/100 mm between the end surfaces of the shroud plates. In addition, a control wheel of this type has a temperature of approximately 500° C. at nominal operation. For strength reasons, among others, the rotor and the blades (1 to 4), which are usually machined from the solid, consist of different materials, the former, for example, of a steel to DIN 21 Cr V 511, where a solid rotor is involved, and the latter of a 13% chromium steel. The thermal expansions of the rotor and blades cause an additional clearance between the end surfaces of adjacent shroud plates of approximately 2/100 mm, caused, in particular, by the differing expansion coefficients of the materials; the rotor spreads at a greater rate than the shroud plates lengthen in the peripheral direction.

In the absence of countermeasures, an unallowable operating clearance of approximately 3/100 mm would occur. In order to bridge over this clearance, ie. in order to achieve a clearance-free connection of the rotor blades, the damping wires 7 are provided and these ensure an effective connection between two neighboring shroud plates during the whole operation.

In the peripheral direction, two wires 7 of this type run adjacent to one another on the shroud plates. The turned recesses 8 for the wires are only machined into the shroud plates when the rotor is fully bladed. They are flanked on both sides by prongs 9, whose inner flanks are preferably directed radially. After insertion of the wire 7 preformed to the necessary diameter, the prongs are pressed around the wire using a device appropriate to the purpose. They enclose the wire over the major portion of its periphery. The height and the cross-section of the prongs 9 are dimensioned in such a way that a chip removal machining operation is generally unnecessary after the rolling process.

Figure 3A:
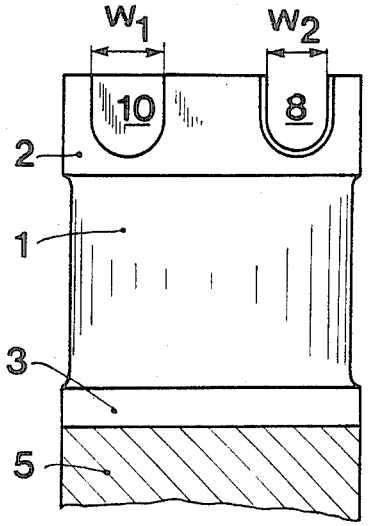
Figure 3B:
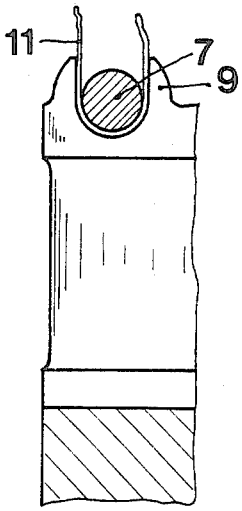
Figure 3C:
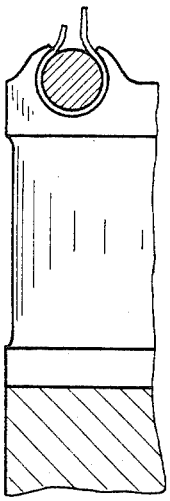

Up to this point, shroud band or shroud plate connections are known. According to the invention, grooves 10 are now machined in the unfinished shroud plates in the end surfaces remote from the flow before mounting the blades. In the present case, their extension in the peripheral direction is approximately 5 mm when a damper wire of 10 mm diameter is used (FIG. 1 and FIG. 2). Their clear width $w_1$ is dimensioned somewhat larger than the width $w_2$ of the turned recess 8 provided for the wire (FIG. 3*a*, left-hand part). It may be seen from FIG. 3*b* that a strip 11 of flexible material is laid in the region of the groove under the damper wire 7 laid in the turned recess. This strip, in the present case a hard paper, has a thickness corresponding to the clearance between the wire and the groove. Its width is approximately twice the extent of the groove in the peripheral direction so that the two opposing grooves of neighboring blades are more or less completely filled by only one common strip.

During the subsequent rolling procedure, the inserted spacer means is only squashed together to an unimportant extent. Metallic contact between the wire and the shroud band is avoided in the region of the grooves. Frictional connection and positive connection between the wire and the shroud band is achieved only outside the groove zones.

During the initial commissioning, the inserted squashed material is burnt to ashes because of the operating temperature, so that a defined clearance occurs between the wire and the shroud band in the groove region. During operation, if the shroud bands gape apart, the wire, which is generally manufactured from the same material as the blades, only expands in the uncaulked zone of the groove. Blade vibrations do not have a disadvantageous effect on the wire at the points at which the wire penetrates the shroud bands.

It is, of course, possible to embody the invention in other specific forms than those of the preferred embodiment described above. This may be done without departing from the essence of the invention. The preferred embodiment is merely illustrative and should not be considered restrictive in any way. The scope of the invention is embodied in the appended claims rather than in the preceding description and all variations and changes which fall within the range of the claims are intended to be embraced therein.

I claim:

1. A rotor blade ring of an axial flow turbomachine comprising:

a rotor;

a plurality of rotor blades, each including a root at a radially inner end, means to fasten said roots to said rotor, and a shroud plate at a radially outer end;

said shroud plate having a radially outer surface and peripheral end surfaces;

a recess of a first width extending between said end surfaces in a peripheral direction in the radially outer surface of each shroud plate;

grooves formed in said peripheral end surfaces colinear with said recess, said grooves being of a second width greater than said first width and extending a first distance in the direction of said recess;

a wire provided in the recess of said shroud plates such that said shroud plates are connected together in the peripheral direction by said wire, means to hold said wires in said recess, and removable spacer means surrounding said wire in the region of said grooves.

2. The rotor blade ring as claimed in claim 1, wherein said removable spacer means is a strip-shaped, flexible material with a width corresponding approximately to twice said first distance and which is in opposing grooves under the wire connecting two adjacent shrouds in each case.

3. The rotor blade ring as claimed in claim 2, wherein said spacer means material is a hard paper which burns to ashes during turbomachine operation.

* * * * *